US008911143B2

(12) United States Patent
Kitahara et al.

(10) Patent No.: US 8,911,143 B2
(45) Date of Patent: Dec. 16, 2014

(54) SWITCH DEVICE

(71) Applicant: Casio Computer Co., Ltd., Shibuya-ku, Tokyo (JP)

(72) Inventors: Masaaki Kitahara, Mizuho-machi (JP); Naohiko Sakurazawa, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/962,817

(22) Filed: Aug. 8, 2013

(65) Prior Publication Data

US 2014/0078872 A1 Mar. 20, 2014

(30) Foreign Application Priority Data

Sep. 19, 2012 (JP) ..... 2012-206084

(51) Int. Cl.
*G04B 29/00* (2006.01)
*G04B 37/10* (2006.01)
*G04B 3/04* (2006.01)

(52) U.S. Cl.
CPC ..... *G04B 37/106* (2013.01); *G04B 3/04* (2013.01); *G04B 37/10* (2013.01)
USPC ..... 368/319; 368/308

(58) Field of Classification Search
USPC ..... 368/319–321, 190, 206, 216, 308; 16/441
See application file for complete search history.

(56) References Cited

U.S. PATENT DOCUMENTS

| | | | | |
|---|---|---|---|---|
| 3,887,963 | A * | 6/1975 | Harmon et al. | 16/441 |
| 6,453,512 | B1 * | 9/2002 | Kaelin et al. | 16/441 |
| 7,025,494 | B2 * | 4/2006 | Oomori et al. | 368/190 |
| 7,111,977 | B2 * | 9/2006 | Hiranuma et al. | 368/289 |
| 7,255,473 | B2 | 8/2007 | Hiranuma et al. | |

FOREIGN PATENT DOCUMENTS

JP 2006-194834 A 7/2006

* cited by examiner

*Primary Examiner* — Sean Kayes
(74) *Attorney, Agent, or Firm* — Holtz, Holtz, Goodman & Chick PC

(57) ABSTRACT

A switch device of the present invention includes a cylindrical member attached to a through hole of a wristwatch case, an operation member having an operation shaft section inserted into the cylindrical member and an operation head section provided at the outer end of the operation member, a cushioning member attached to the operation head section of the operation member to cover the operation head section, and an exterior member fixed to the operation head section to cover the cushioning member and from which a plurality of portions of the cushioning member project outwardly. Therefore, when the exterior member receives an external impact, the impact can be mitigated by the cushioning member projecting outwardly from the exterior member. As a result, the operation member and the cylindrical member can be prevented from being damaged by the external impact, whereby the impact resistance can be increased.

6 Claims, 15 Drawing Sheets

SWITCH DEVICE

CROSS-REFERENCE TO RELATED APPLICATION

This application is based upon and claims the benefit of priority from the prior Japanese Patent Application No 2012-206084, filed Sep. 19, 2012, the entire contents of which are incorporated herein by reference.

BACKGROUND OF THE INVENTION

1. Field of the Invention

The present invention relates to a switch device for use in a timepiece such as a wristwatch.

2. Description of the Related Art

For example, a wristwatch is known which includes a switch device having an operation member such as a crown provided on the wristwatch case so as to be able to be pulled out, as described in Japanese Patent Application Laid-Open (Kokai) Publication No. 2006-194834.

This type of switch device is structured such that the operation member projecting outwardly from the wristwatch case is pulled out and the operation member is rotated in this state, whereby the time is corrected.

In the structure of this switch device, a winding-stem pipe is attached to a through hole of the wristwatch case, a shaft section of the operation member is inserted into the winding-stem pipe, an outer end of the winding stem is attached to the shaft section of the operation member and an operation head section projecting outwardly from the wristwatch case is provided at the outer end of the shaft section.

This switch device also includes a lock section which locks the operation member in a pushed state when the time is not corrected. The lock section includes a ring member having a plurality of engaging projections attached to the operation head section and a plurality of engaging groove sections provided on the outer perimeter of the winding-stem pipe projecting outwardly from the wristwatch case to engageably lock the engaging projections of the ring member.

In this switch device, when the operation member is rotated, the engaging projections of the ring member rotate to release locks of the engaging projections with respect to the plurality of engaging groove sections. In this state, the operation member is pulled out for rotating operation, and thereby the time can be corrected. Also, when the operation member is pushed in to be rotated, the engaging projections of the ring member rotate to be engaged with the plurality of engaging groove sections, whereby the operation member is locked in a pushed state.

However, there is a problem in this type of switch device in that, in both of the cases where the operation member is pushed in and locked and where the lock is released and the operation member is pulled out, when the operation head section of the operation member receives an external impact the impact is directly exerted onto the operation member and the winding-stem pipe, whereby the operation member and the winding-stem pipe are damaged, and the sealing performance of the winding-stem pipe with respect to the wristwatch case is decreased.

SUMMARY OF THE INVENTION

The present invention is to provide a switch device capable of increasing impact resistance by mitigating an external impact.

In order to achieve the above-described object, accordance with one aspect of the present invention, there is provided a switch device comprising: a case having a through hole; a cylindrical member attached to the through hole of the case; an operation member having a shaft section inserted into the cylindrical member and an operation section provided at outer end of the operation member; a cushioning member attached to the operation section of the operation member to cover the operation section; and an exterior member fixed to the operation section to cover the cushioning member and from which a plurality of portions of the cushioning member project outwardly.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 5A and FIG. 5B depict a cross section of the main portion of the switch device depicted in FIG. 3, of which FIG. 5A is an enlarged sectional view of the main portion taken along line B-B in FIG. 3, and FIG. 5B is an enlarged sectional view of the main portion taken along line C-C in FIG. 3;

FIG. 9A and FIG. 9B depict a cross section of the main portion of the switch device depicted in FIG. 7, of which FIG. 9A is an enlarged sectional view of the main portion taken along line D-D in FIG. 7, and FIG. 9B is an enlarged sectional view of the main portion taken along line. E-E in FIG. 7;

FIG. 12A and FIG. 12B each depict a cross section of the main portion of the switch device depicted in FIG. 10, of which FIG. 12A is an enlarged sectional view of the main portion taken along line F-F in FIG. 10, and FIG. 12B is an enlarged sectional view of the main portion taken along line G-G in FIG. 10;

FIG. 15A and FIG. 15B each depict a cross section of the main portion of the switch device depicted in FIG. 13, of which FIG. 15A is an enlarged sectional view of the main portion taken along line H-H in FIG. 13, and FIG. 15B is an enlarged sectional view of the main portion taken along line I-I in FIG. 13;

DETAILED DESCRIPTION OF THE PREFERRED EMBODIMENTS

First Embodiment

A first embodiment in which the present invention has been applied to a switch device of a wristwatch is described below with reference to FIG. 1 to FIG. 5B.

Figure 1:
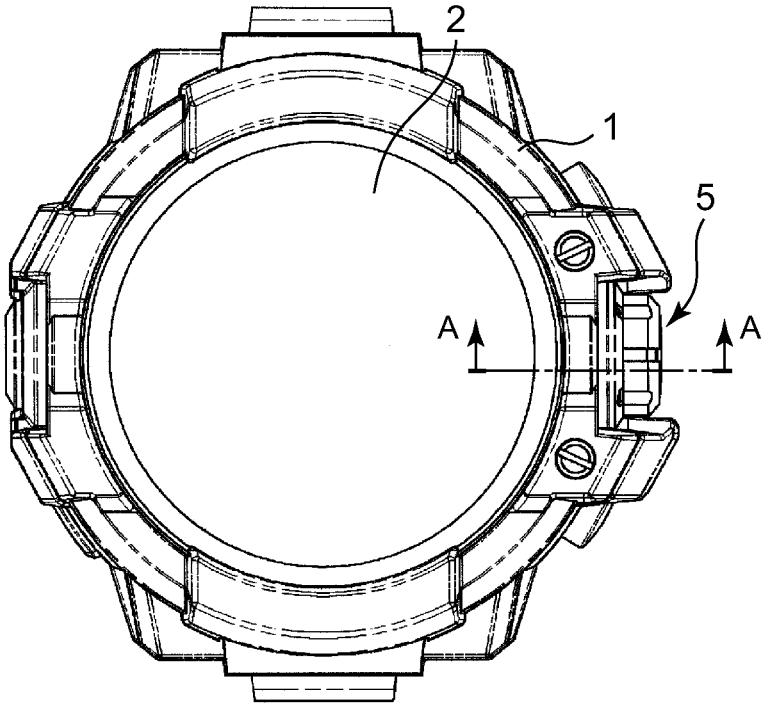
FIG. 1 is an enlarged front view of a wristwatch according to a first embodiment in which the present invention has been applied to a switch device of a wristwatch.
Figure 2:
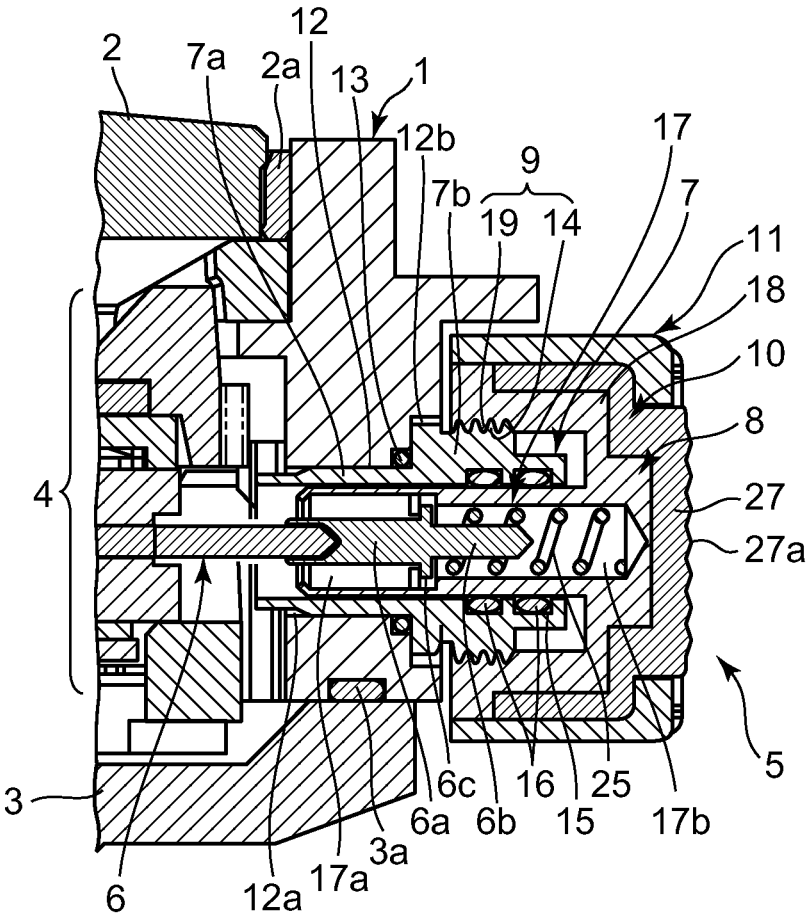
FIG. 2 is an enlarged sectional view of the main portion of the wristwatch taken along line A-A in FIG. 1.

The wristwatch includes a wristwatch case 1, as depicted in FIG. 1 and FIG. 2. The wristwatch case 1 has an upper opening to which a timepiece class 2 is attached via a gasket 2*a*, and a rear lid 3 is attached to the lower portion of the wristwatch case 1 via a waterproof gasket 3*a*.

In the wristwatch case 1, a timepiece module 4 is provided, as depicted in FIG. 2.

Also, at a side portion on the three o'clock side of the wristwatch case 1, a switch device 5 is provided, as depicted in FIG. 1 and FIG. 2.

The switch device 5 is to perform a mode change, time correction, etc., of the timepiece module 4, and includes a winding stem 6, a cylindrical member 7, an operation member 8, a lock section 9, a cushioning member 10, and an external member 11.

In this case, the side portion on the three o'clock side is provided with a through hole 12 penetrating from the inside to outside of the wristwatch case 1, as depicted in FIG. 2.

The through hole 12 has a small-diameter hole section 12*a* positioned inside of the wristwatch case 1 and a large-diameter hole section 12*b* positioned outside the wristwatch case 1

The cylindrical member 7 of the switch device 5 is fitted into this through hole 12.

The cylindrical member 7 includes a small-diameter cylinder section 7*a* that is fitted into the small-diameter hole section 12*a* of the through hole 12 and projects toward the inside of the wristwatch case 1, and a large-diameter cylinder section 7*b* that is fitted into the large-diameter hole section 12*b* of the through hole 12 and projects toward the outside of the wristwatch case 1, as depicted in FIG. 2.

The small-diameter cylinder section 7*a* of the cylindrical member 7 is bonded to the inside of the through hole 12 of the wristwatch case 1 by welding with a wax material 13 provided to a step portion between the small-diameter cylinder section 7*a* and the large-diameter cylinder section 7*b*.

As a result, by welding of the wax material 13, the cylindrical member 7 does not move out of the wristwatch case 1, and is attached to the inside of the through hole 12 of the wristwatch case 1, as depicted in FIG. 2.

By welding of the wax material 13, the cylindrical member 7 has waterproofness between the through hole 12 of the wristwatch case 1 and the small-diameter cylinder section 7*a*.

The large-diameter cylinder section 7*b* of the cylindrical member 7, that is, the outer peripheral surface of the large-diameter cylinder section 7*b* projecting outwardly from the through hole 12 of the wristwatch case 1, has an outer peripheral surface provided with a male screw section 14 of the lock section 9, as depicted in FIG. 2.

The cylindrical member 7 has an inner peripheral surface provided with a plurality of gasket grooves 15 as depicted in FIG. 2. To each of the plurality of these gasket grooves 15, a waterproof gasket 16 is attached.

On the other hand, as depicted in FIG. 2 to FIG. 5B, the operation member 8 includes an operation shaft section 17 formed in a cylindrical shape with a small diameter slightly smaller than the inner diameter of the cylindrical member 7 and an operation head section 18 provided to an outer end of the operation shaft section 17 and formed in a cylindrical shape with a large diameter.

The inner side of the operation head section 18 is formed in a hollow shape which is approximately identical in size to the outer diameter of the male screw section 14 of the lock section 9 provided to the cylindrical member 7.

The length (depth) of the inner side of the operation head section 18 in the axial direction is formed to be slightly longer than the length of a portion of the large-diameter cylinder section 7*b* of the cylindrical member 7 projecting outwardly from the wristwatch case 1.

On the inner peripheral surface of the operation head section 18 on the wristwatch case 1 side, a female screw section 19 is provided into which the male screw section 14 of the lock section 9 provided to the cylindrical member 7 is screwed.

The female screw section 19 is structured to be screwed into the male screw section 14 when the operation member 8 is pushed in toward the wristwatch case 1.

Figure 5A:
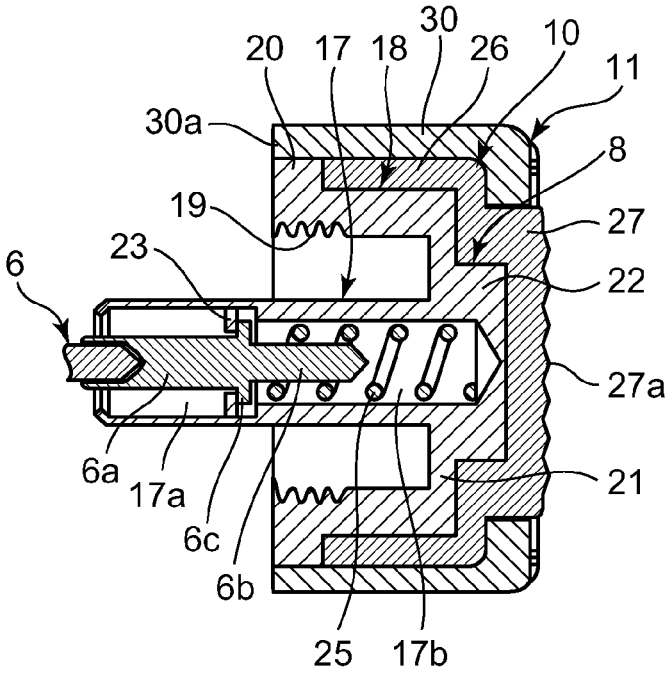
Figure 5B:
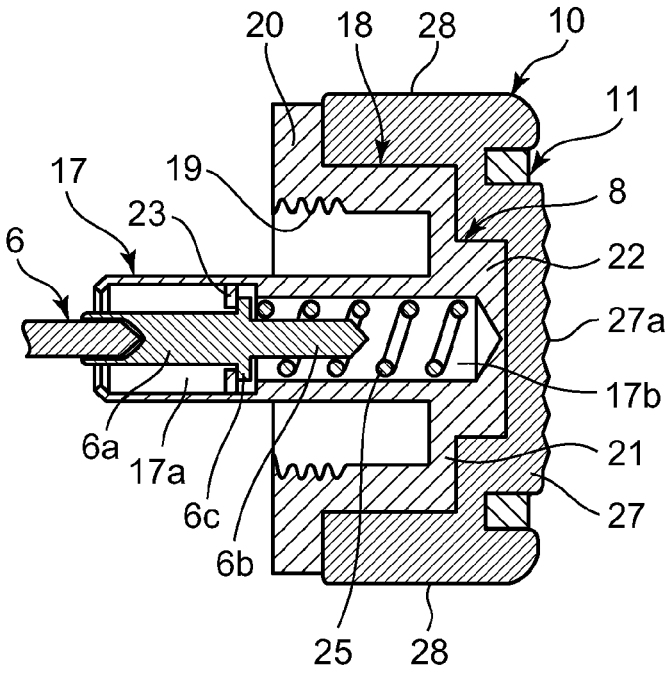

As a result, the lock section 9 is structured by the male screw section 14 provided on the outer peripheral surface of the cylindrical member 7 and the female screw section 19 provided on the inner peripheral surface of the operation head section 18, as depicted in FIG. 2, FIG. 5A, and FIG. 5B.

The lock section 9 is structured such that, when the operation member 8 is pushed in toward the inside of the wristwatch case 1 to cause the female screw section 19 to approach the male screw section 14, the female screw section 19 is screwed into the male screw section 14 by the rotation of the operation head section 18 to cause the operation member 8 to be locked in a pushed state.

On the outer peripheral portion of the operation head section 18 on the wristwatch case 1 side, an annular mount collar section 20 is provided projecting in the diameter direction, as depicted in FIG. 2, FIG. 5A, and FIG. 5B.

Also, on the outer end of the operation head section 18 on the outer side of the wristwatch case 1, a head wall section 21 is provided.

On the outer surface of this head wall section 21, a columnar projection 22 smaller than the outer diameter of the operation head section 18 is formed.

The operation shaft section 17 is a cylindrical portion inserted into the inside of the cylindrical member 7, as depicted in FIG. 2 to FIG. 5B, and is provided at the center portion of the inner surface of the operation head section 18 so as to project toward the wristwatch case 1 side.

The operation shaft section 17 is formed to have a length slightly shorter than the length of the cylindrical member 7.

As a result, the operation shaft section 17 is structured so as not to project toward the inside of the wristwatch case 1 from the inside of the cylindrical member 7 when the operation member 8 is pushed in to be locked by the lock section 9.

Inside of the operation shaft section 17, a rectangular hole section 17*a* and a circular hole section 17*b* are provided along the axial direction. The rectangular hole section 17*a* has a rectangular cross-sectional shape and is provided at a position projecting from the operation head section 18 toward the wristwatch case 1. The circular hole section 17*b*, which has a circular cross-sectional shape, is provided on the operation head section 18 side with respect to the rectangular hole section 17*a*, and continuously inscribed in the inner surface of the rectangular hole section 17*a*, as depicted in FIG. 2, FIG. 5A and FIG. 5B.

Also, inside of the operation shaft section 17, the tip of the winding stem 6 is movably attached along the axial direction, as depicted in FIG. 2, FIG. 5A and FIG. 5B.

That is, the winding stem 6 includes a gang shaft section 6*a* that is formed in a rectangular rod shape and movably inserted into the rectangular hole section 17*a* of the operation shaft section 17, and a guide shaft section 6*b* that is provided at the tip of the gang shaft section 6*a* and movably inserted into the circular hole section 17*b* of the operation shaft section 17.

In this case, at the tip of the gang shaft section 6*a* of the winding stem 6, that is, at the boundary between the gang shaft section 6*a* and the guide shaft section 6*b*, a stopper collar section 6*c* is provided projecting in the diameter direction, as depicted in FIG. 2, FIG. 5A and FIG. 5B.

The stopper collar section 6*c* is provided with a guide ring 23 having a rectangular plate shape.

The guide ring 23 is structured to be movably inserted into the rectangular hole section 17*a* of the operation shaft section 17 and transfers the rotation of the operation shaft section 17 to the gang shaft section 6*a* to rotate the gang shaft section 6*a* in this state.

The guide shaft section 6*b* of the winding stem 6 is formed to be sufficiently narrower than the inner diameter of the circular hole section 17*b*, as depicted in FIG. 2, FIG. 5A and FIG. 5B.

Between the outer peripheral surface of the guide shaft section 6*b* and the inner peripheral surface of the circular hole section 17*b*, a coil spring 25 is placed.

The coil spring 25 is structured such that one end elastically comes in contact with the stopper collar section 6*c* of the winding stem 6 and the other end elastically comes in contact with a recess portion (in FIG. 5A, a right end portion) of the circular hole section 17*b* of the operation shaft section 17. In this state, the coil spring 25 presses the operation shaft section 17 in a direction of pushing out from the inside of the cylindrical member 7.

As a result, in the operation member 8, when the operation head section 18 is pushed in against the spring force of the coil spring 25, the coil spring 25 is compressed by the stopper collar section 6*c* of the winding stem 6 and the gang shaft section 6*a* of the winding stem 6 is relatively pushed into the rectangular hole section 17*a* of the operation shaft section 17, as depicted in FIG. 2, FIG. 5A and FIG. 5B.

Also, the operation member 8 is structured such that the guide shaft section 6*b* of the winding stem 6 is relatively pushed into the circular hole section 17*b* of the operation shaft section 17 to cause the operation head section 18 to approach the wristwatch case 1.

Moreover, the operation member 8 is structured such that, with the guide shaft section 6*b* of the winding stem 6 being relatively pushed into the circular hole section 17*b* of the operation shaft section 17 to cause the operation head section 18 to approach the wristwatch case 1 and be locked by the lock section 9, when the lock of the lock section 9 with respect to the operation shaft section 17 is released, the operation shaft section 17 is pushed out by the spring force of the coil spring 25 with respect to the winding stem 6 and the operation head section 18 projects outwardly away from the wristwatch case 1, as depicted in FIG. 2, FIG. 5A and FIG. 5B.

Furthermore, the operation member 8 is structured such that, even when the operation head section 18 has been pushed into or even when the operation head section 18 has been pushed out, if the operation head section 18 is rotated, the operation shaft section 17 rotates together with the operation head section 18, the rotation is transferred by the guide ring 23 to the gang shaft section 6*a* of the winding stem 6 inserted into the rectangular hole section 17*a* of the operation shaft section 17, and the rotation of the gang shaft section 6*a* causes the winding stem 6 to rotate, as depicted in FIG. 2, FIG. 5A and FIG. 5B.

On the other hand, the operation head section 18 of the operation member 8 has the cushioning member 10 and the exterior member 11 attached thereto, as depicted in FIG. 3 to FIG. 5B.

The cushioning member 10 is made of synthetic resin having elasticity such as urethane rubber, silicone rubber, or an elastomer, and includes a cushioning body 26 closely attached to the outer peripheral surface of the operation head section 18.

The cushioning body 26 is formed in a cylindrical shape attached to the outer peripheral surface of the operation head, section 18.

Figure 4:
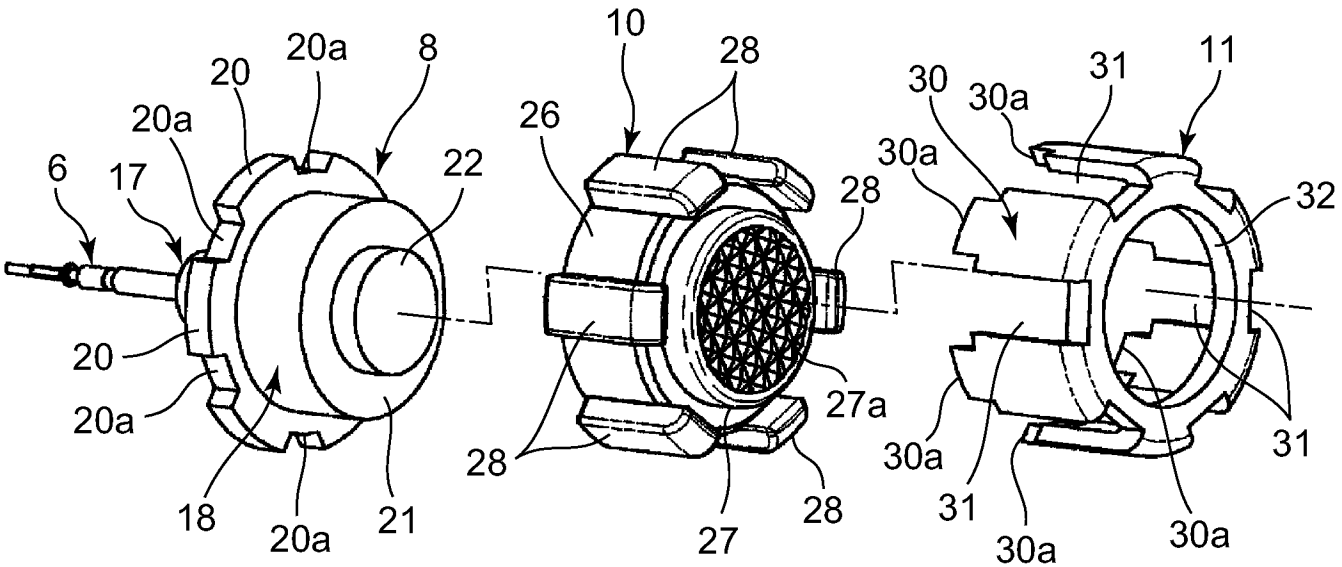
FIG. 4 is an enlarged exploded perspective view of the main portion of the switch device depicted in FIG. 3.

That is, the cushioning body 26 is formed such that its outer shape has an outer diameter that is short enough not to obstruct a plurality of mount grooves 20*a* provided to the mount collar section 20 of the operation head section 18, or in other words, an outer diameter equal in size to that of a circular portion at the bottom of each of the plurality of mount grooves 20*a*, as depicted in FIG. 4, FIG. 5A and FIG. 5B.

Figure 3:
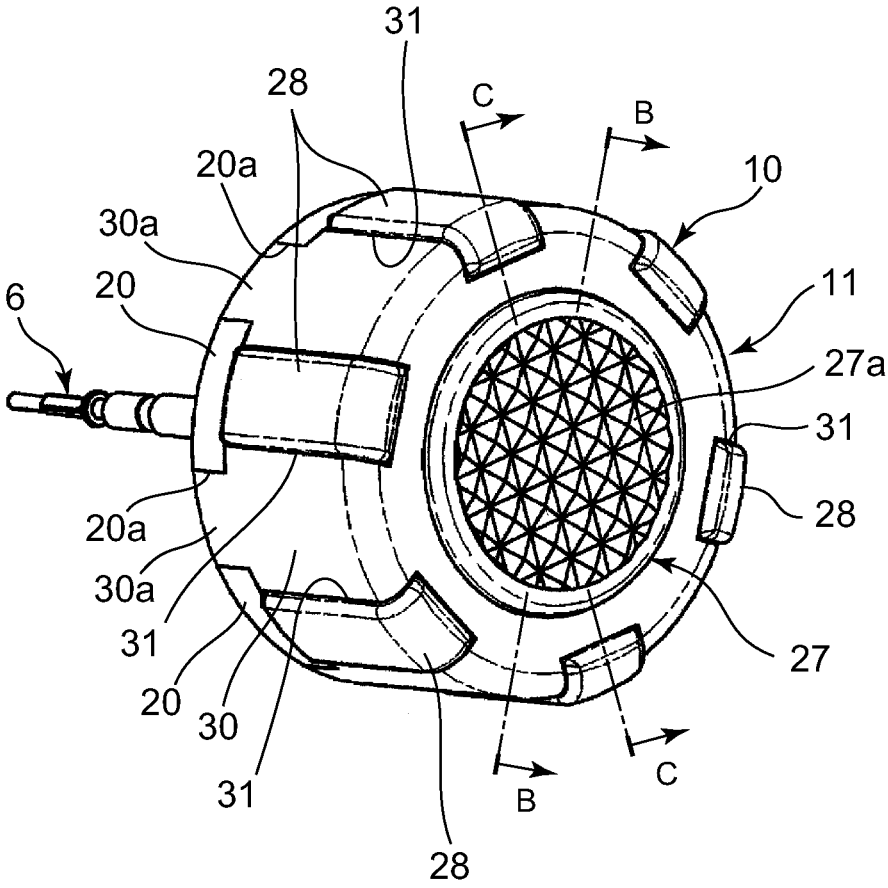
FIG. 3 is an enlarged sectional view of the main portion of the switch device depicted in FIG. 2.

At the outer end of the cushioning body 26, a tip elastic projection 27 is formed so as to project, as depicted in FIG. 3 and FIG. 4.

On the outer end surface of this tip elastic projection 27, a concavo-convex section 27*a* is formed.

Also, on the outer peripheral surface of the cushioning body 26, a plurality of outer peripheral elastic projections are formed equidistantly along the circumferential direction, as depicted in FIG. 3 to FIG. 5B.

The outer peripheral elastic projections 28 are formed having a thickness thicker than that of the exterior member 11.

Also, the outer peripheral elastic projections 28 are formed on the outer peripheral surface of the cushioning body 26 along the axial direction.

That is, the outer peripheral elastic projections 28 are each formed such that one end thereof (in FIG. 4, left end) is positioned at the mount collar section 20 of the operation head section 18, the other end (in FIG. 4, right end) projects from the outer end of the cushioning body 26, and this projecting tip surface is located at a position that is substantially the same as the position of the outer end surface (in FIG. 4, right end surface) of the tip elastic projection 27, as depicted in FIG. 3 to FIG. 5B.

The exterior member 11 is made of metal, and is structured to be attached to the outer perimeter of the cushioning member 10, as depicted in FIG. 3 to FIG. 5B.

That is, the exterior member 11 is structured such that a plurality of slit grooves 31 are formed at the outer peripheral portion of a cylindrical section 30 along the shaft direction.

In this case, the cylindrical section 30 is formed so as to have one end (in FIG. 4, a left end) positioned at the mount collar section 20 of the operation head section 18 and the other end (in FIG. 4, a right end) positioned at the outer end of the cushioning body 26.

Also, the one end of the cylindrical section 30 is provided with a plurality of fitting projections 30*a* fitting and, fixed by being swaged to the plurality of mount grooves 20*a* provided on the mount collar section 20 of the operation head section 18, as depicted in FIG. 4, FIG. 5A and FIG. 5B.

Furthermore, the other end of the cylindrical section 30 is provided with an insertion hole 32 in which the tip elastic projection 27 of the cushioning member 10 is inserted to project outward.

The plurality of slit grooves 31 are each formed from one end to the other end of the cylindrical section 30 and have a width approximately equal to the width (the length in the circumferential direction) of each of the outer peripheral elastic projections 28, as depicted in FIG. 3 to FIG. 5B.

Also, the plurality of slit grooves 31 are formed on the outer peripheral surface of the cylindrical section 30 equidistantly in the circumferential direction.

As a result, the plurality of slit grooves 31 are structured such that the plurality of outer peripheral elastic projections 28 formed on the outer peripheral surface of the cushioning member 10 are each inserted into the plurality of slit grooves 31 to project from the outer peripheral surface of the cylindrical section 30 when the cylindrical section 30 is attached to the exterior member 11 of the cushioning member 10.

The winding stem 6 coupled to the operation member 8 is placed to be extended to the inside of the timepiece module 4 provided inside the wristwatch case 1, as depicted in FIG. 2.

The winding stem 6 is structured such that a state where the switch of the timepiece module 4 is not operated is kept when the operation head section 18 of the operation member 8 is pushed in to compress the coil spring 25 and the female screw section 19 of the operation member 8 is screwed into the male screw section 14 of the cylindrical member 7 to lock the operation member 8.

Also, the winding stem 6 is structured to keep the state where the switch of the timepiece module 4 is not operated even when the operation head section 18 of the operation member 8 is rotated to release screwing of the female screw section 19 of the operation member 8 with respect to the male screw section 14 of the cylindrical member 7 and the operation head section 18 of the operation member 8 is pushed out by the spring force of the coil spring 25, as depicted in FIG. 2.

Furthermore, in the state of the winding stem 6 depicted in FIG. 2, the lock of the lock section 9 with respect to the operation member 8 is released to push out the operation member 8.

Then, in this state, when the operation head section 18 of the operation member 8 is further pulled out, the winding stem 6 moves in a direction of being pulled out according to the pulling-out operation of the operation head section 18.

As a result, a normal timepiece mode is switched to a time correction mode. In this state, when the operation head section 18 is rotated, the switch device 5 is rotated accordingly, and performs time correction according to this rotation.

Next, the operation of the switch device 5 of the wristwatch is described.

When the switch device 5 is to be used, in the state depicted in FIG. 2, the exterior member 11 provided to the operation head section 18 of the operation member 8 is pinched and rotated.

Then, the operation head section 18 rotates via the cushioning member 10, the female screw section 19 of the operation member 8 rotates along with this the rotation, and the lock of the lock section 9 with respect to the operation member 8 is released.

That is, when the exterior member 11 is pinched and rotated, the fitting projections 30*a* of the exterior member 11 fit in the mount grooves 20*a* of the mount collar section 20 of the operation head section 18, whereby the rotation of the exterior member 11 is transferred to the operation head section 18, and the operation head section 18 is rotated.

Together with this, the operation shaft section 17 of the operation member 8 rotates simultaneously.

When the operation head section 18 rotates in this manner, the female screw section 19 of the operation head section 18 rotates, whereby the screwing of the female screw section 19 with respect to the male screw section 14 of the cylindrical member 7 is released to cause the female screw section 19 to be disengaged from the male screw section 14.

As a result, the lock with respect to the operation member 8 by the lock section 9 is released.

As such, when the lock with respect to the operation member 8 by the lock section 9 is released, the operation shaft section 24 of the operation member 8 is pushed out toward the outside of the wristwatch case 1 by the spring force of the coil spring 25 provided inside the operation shaft section 17 of the operation member 8.

Here, the winding stem 6 does not move in the axial direction.

Accordingly, the gang shaft section 6*a* of the winding stem 6 relatively moves out of the operation shaft section 17 according to the movement of the operation shaft section 17.

Also, the guide shaft section 6*b* of the winding stem 6 relatively moves toward the inside of the rectangular hole section 17*a* of the operation shaft section 17 according to the movement of the operation shaft section 17.

When the operation shaft section 17 moves toward the outside of the wristwatch case 1 in the cylindrical member 7 as described above, the operation head section 18 moves away from the wristwatch case 1 to project outwardly.

In this state, even if the operation head section 18 is rotated to rotate the winding stem 5, the switch of the timepiece module 4 does not operate.

Then, when the operation head section 18 is further pulled out, the winding stem 6 is pulled out accordingly.

Here, the operation of pulling out the winding stem 6 causes the switch of the timepiece module 4 to operate, whereby the timepiece mode is switched from the normal timepiece mode to the time correction mode.

In this state, when the operation head section 18 is rotated, the winding stem 6 rotates accordingly, and the time is corrected according to this rotation.

On the other hand, when the switch device 5 is not to be used, the operation head section 18 of the operation member 8 is pushed in against the spring force of the coil spring 25 to approach the outer surface of the wristwatch case 1, as depicted in FIG. 2.

Then, the female screw section 19 of the operation head section 18 approaches the male screw section 14 of the cylindrical member 7 to become screwable.

In this state, when the exterior member 11 is rotated to rotate the operation head section 18, the female screw section 19 of the operation head section 18 is screwed into the male screw section 14 of the cylindrical member 7.

Accordingly, the operation member 8 is locked by the lock section 9 in the state of being pushed in.

As such, the switch device 5 of the wristwatch includes the wristwatch case 1 having the through hole 12, the cylindrical member 7 attached to the through hole 12 of the wristwatch case 1, the operation member 8 having the operation shaft section 17 inserted into the cylindrical member 7 and the operation head section 18 at the outer end, the lock section 9 which locks the operation member 8 with it being pushed in toward the wristwatch case 1, the cushioning member 10 attached to cover the operation head section of the operation member 8, and the exterior member 11 which covers the cushioning member 10 so as to be fixed to the operation head section 18, and has a plurality of portions of the cushioning member 10 projecting outwardly.

As a result of this structure, an impact can be mitigated by the cushioning member 10, whereby impact resistance can be increased.

That is, in both states of the switch device 5 where the operation member 8 has been pushed in toward the wristwatch case 1 and locked by the lock section 9 and where the lock by the lock section 9 has been released and the operation member 8 has been pushed out from the wristwatch case 1, an external impact received by the exterior member 11 can be mitigated by the cushioning member 10 projecting outwardly from the exterior member 11.

Accordingly, the external impact is not directly applied to the operation member 8 and the cylindrical member 7, whereby the operation member 8 and the cylindrical member 7 are prevented from being damaged by the external impact and the impact resistance is increased.

In this case, the exterior member 11 has the plurality of slit grooves 31 provided from its outer peripheral surface to its outer end surface along the circumferential direction, at predetermined intervals. The cushioning member 10 is provided with the plurality of outer peripheral elastic projections 28 projecting outwardly from the plurality of slit grooves 31 of the exterior member 11.

As a result, when the exterior member 11 receives an external impact, the impact can be mitigated by the plurality of outer peripheral elastic projections 23 of the cushioning member 10 projecting outwardly from the exterior member 11.

Accordingly, the external impact is not directly applied to the operation member 8 and the cylindrical member 7, whereby the operation member 8 and the cylindrical member 7 are prevented from being damaged by the external impact.

Also, the plurality of outer peripheral elastic projections 28 of the cushioning member 10 project from the outer peripheral surface of the exterior member 11. With this, when the exterior member 11 is pinched between fingers for rotating operation, the plurality of outer peripheral elastic projections 28 projecting from the outer peripheral surface of the exterior member 11 prevent the fingers from sliding.

As a result, the operation member 8 can be accurately and favorably rotated, whereby good rotation operability can be provided.

Also, the exterior member 11 has the outer end surface provided with the insertion hole 32, and the cushioning member 10 is provided with the tip elastic projection 27 projecting outwardly from the insertion hole 32 of the exterior member 11.

As a result, when the outer end surface of the exterior member 11 receives an impact, the impact can be mitigated by the tip elastic projection 27 of the cushioning member 10 projecting outwardly from the insertion hole 32 of the exterior member 11.

Accordingly, the external impact is not directly applied to the operation member 8 and the cylindrical member 7, whereby the operation member 8 and the cylindrical member 7 are prevented from being damaged by the external impact.

In this case, the outer end surface of the tip elastic projection 27 of the cushioning member 10 projecting outwardly from the insertion hole 32 of the exterior member 11 has the concavo-convex section 27*a* formed thereon.

As a result, when the outer end surface of the exterior member 11 is to be pressed by a finger pulp for rotating operation, the concavo-convex section 27*a* prevents the finger pulp from sliding.

By this structure as well, the operation member 8 can be accurately and favorably rotated, whereby better rotation operability can be provided.

Still further, the switch device 5 includes the lock section 9 which locks the operation member 8 in a state of being pushed in toward the wristwatch case 1.

As a result, the operation member 8 can be locked by the lock section 9 when the operation member 8 is not operated, whereby the operation member 8 can be prevented from inadvertently moving in a direction of projecting from and retracting into the wristwatch case 1.

That is, the lock section 9 includes the male screw section 14 provided to the cylindrical member 7 and the female screw section 19 provided to the operation head section 18.

As a result, by only pushing the operation head section 18 in toward the wristwatch case 1 and then rotating the operation head section 18, the female screw section 19 can be screwed into the male screw section 14, whereby the operation member 8 can be easily and reliably locked.

Second Embodiment

Next, a second embodiment in which the present invention has been applied to a switch device of a wristwatch is described below with reference to FIG. 6 and FIG. 9B.

Note that components identical to those of the first embodiment depicted in FIG. 1 to FIG. 5B are provided with the same reference numerals for description.

Figure 6:
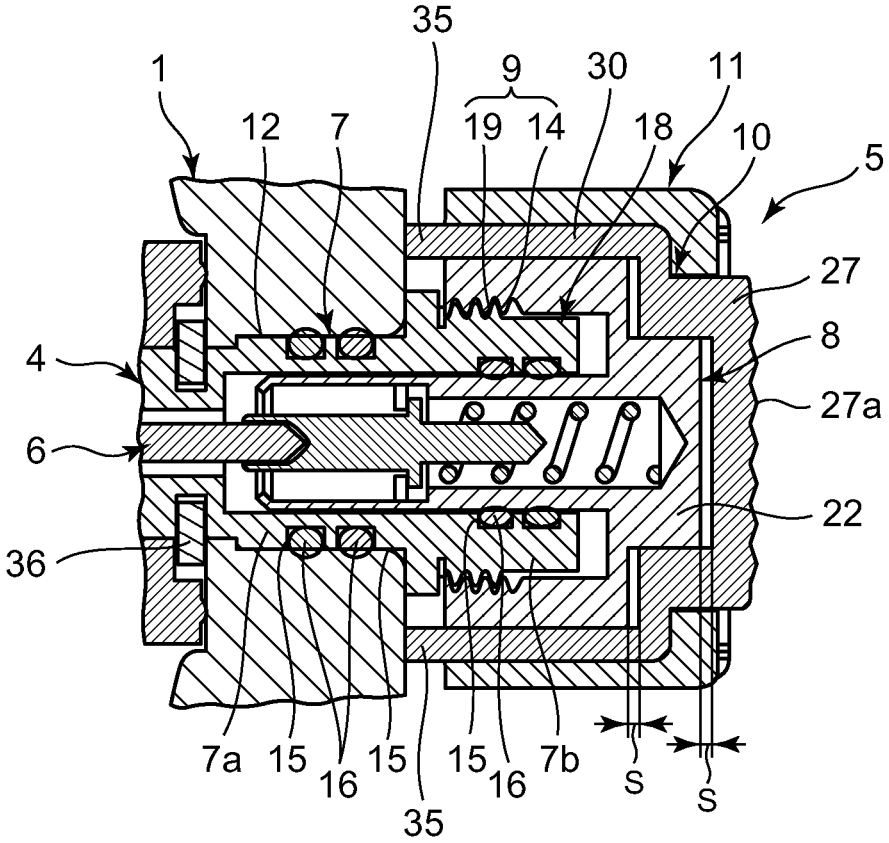
FIG. 6 is an enlarged sectional view of a switch device according to a second embodiment in which the present invention has been applied to a switch device of a wristwatch.
Figure 7:
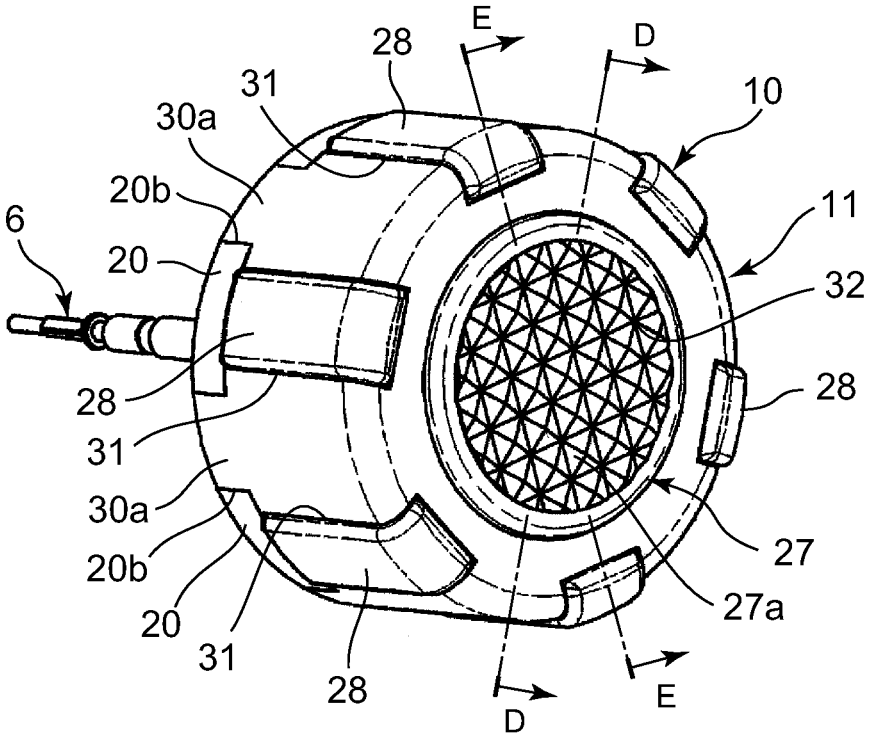
FIG. 7 is an enlarged sectional view of the main portion of the switch device depicted in FIG. 6.

As depicted in FIG. 6, the switch device 5 of the wristwatch has the cushioning member 10 provided with a plurality of elastic stopper sections 35. Except for this point, the switch device 5 is substantially identical in structure to that of the first embodiment.

Figure 8:
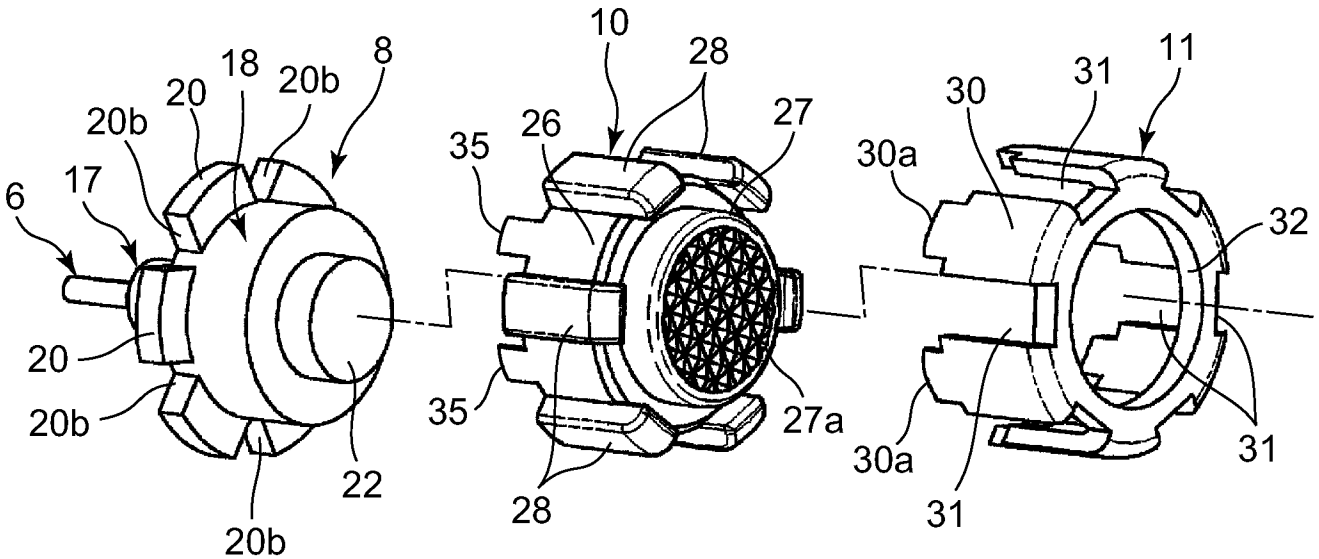
FIG. 8 is an enlarged exploded perspective view of the main portion of the switch device depicted in FIG. 7.
Figure 9A:
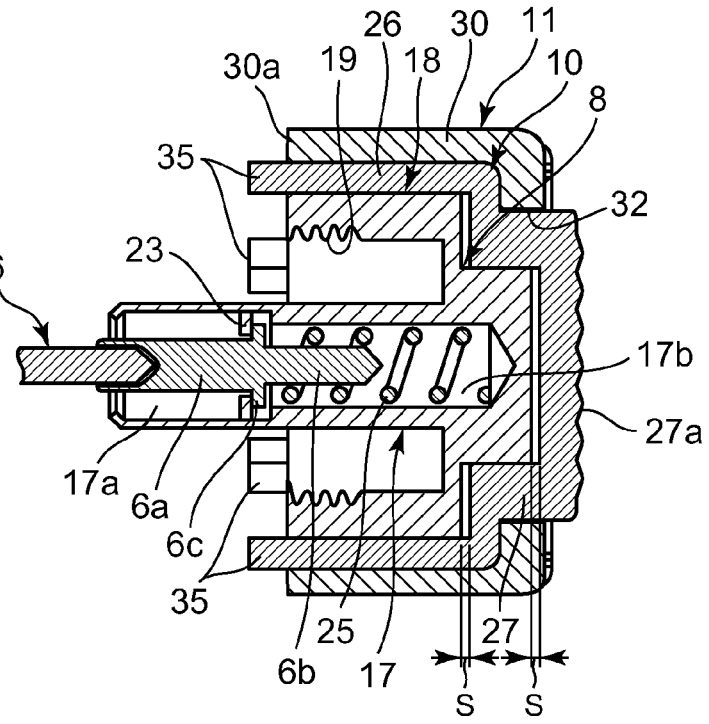
Figure 9B:
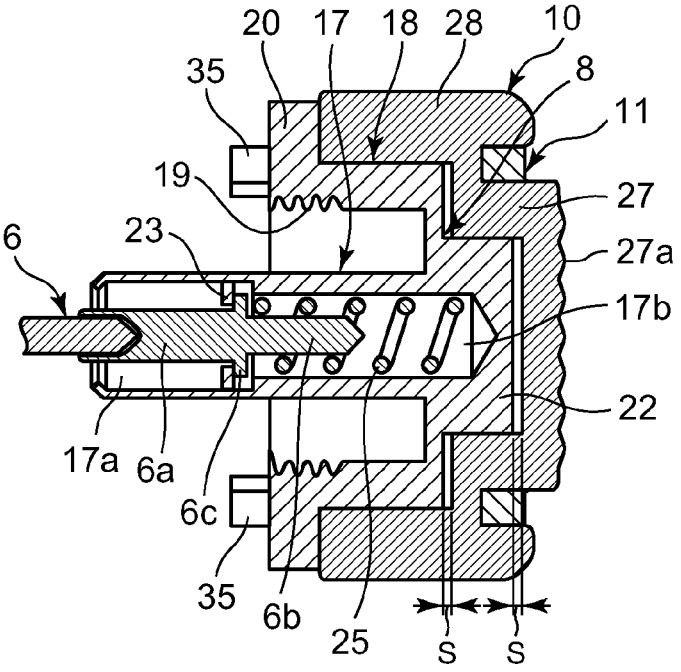

That is, the plurality of elastic stopper sections 35 are each provided projecting from one end (in FIG. 8, a left end) of the cushioning body 26 of the cushioning member 10 toward the outer surface of the wristwatch case 1, as depicted in FIG. 8, FIG. 9A and FIG. 9B.

In this case, the mount collar section 20 provided to the operation head section 18 of the operation member 8 has a plurality of mount grooves 20*b* cut deeper than the mount grooves 20*a* of the first embodiment so that the bottom of the mount grooves 20*b* reaches the outer peripheral surface of the operation head section 18.

As a result, the plurality of elastic stopper sections 35 are structured to project through the plurality of mount groves 20*b* of the mount collar section 20 toward the outer surface of the wristwatch case 1, as depicted in FIG. 6.

Also, the plurality of elastic stopper sections 35 are structured to elastically come in contact with the outer surface of the wristwatch case 1 when the operation head section 18 of the operation member 8 is pushed in toward the wristwatch case 1 and the female screw section 19 of the operation head section 18 is screwed into the male screw section 14 of the cylindrical member 7 for locking.

In this case, the cushioning member 10 is structured to form a space S between the inner surface of the tip elastic projection 27 and the outer end surface of the operation head section 18 when the tip of each of the plurality of elastic stopper sections 35 comes in elastic contact with the outer surface of the wristwatch case 1, as depicted in FIG. 6, FIG. 9A and FIG. 9B.

That is, the space S is provided therebetween such that the inner surface of the tip elastic projection 27 is away from the outer end surface of the operation head section 18 and the outer end surface of the columnar projection 22 of the operation head section 18.

In the structure of the second embodiment, as depicted in FIG. 6, the small-diameter cylinder section 7*a* of the cylindrical member 7 fits into the through hole 12 of the wristwatch case 1 so as to project into the inside of the wristwatch case 1, and a stopper ring 36 such as an E ring is mounted on the projecting small-diameter cylinder section 7*a*. With the stopper ring 36, the small-diameter cylinder section 7*a* of the cylindrical member 7 is prevented from moving out of the through hole 12 of the wristwatch case 1.

Also, on the outer peripheral surface of the small-diameter cylinder section 7*a* of the cylindrical member 7, the plurality of gasket grooves 15 are provided as depicted in FIG. 6. To each of the plurality of gasket grooves 15, the waterproof gasket 16 is attached.

As a result, waterproofness between the through hole 12 of the wristwatch case 1 and the cylindrical member 7 is achieved.

Also, the large-diameter cylinder section 7*b* of the cylindrical member 7 is structured to project to the outside of the wristwatch case 1.

With the above-described switch device 5 of the wristwatch, operations and effects similar to those of the first embodiment can be achieved. In addition, the cushioning member 10 is provided with the plurality of elastic stopper sections 35 that elastically come in contact with the outer surface of the wristwatch case 1, with the operation member 8 being locked by the lock section 9.

As a result, when the exterior member 11 receives an external impact, the impact can be absorbed by the plurality of elastic stopper sections 35 of the cushioning member 10, whereby the impact resistance can be increased more than the first embodiment.

That is, in the switch device 5, with the operation member 8 being pushed in toward the wristwatch case 1 and locked by the lock section 9, when the exterior member 11 receives an external impact, the impact can be mitigated by the tip elastic projection 27 and the outer peripheral elastic projections 26 of the cushioning member 10 projecting outwardly from the exterior member 11.

In addition, the impact can be further absorbed by the plurality of elastic stopper sections 35 of the cushioning member 10.

Accordingly, the external impact can be absorbed more reliably and favorably than the first embodiment.

As a result, the operation member 8 and the cylindrical member 7 can be prevented from being damaged by the external impact more reliably than the first embodiment, whereby the impact resistance can be more increased.

In this case, the cushioning member 10 has the space S between the inner surface of the tip elastic projection 27 and the outer end surface of the operation head section 18 when the tip of each of the plurality of elastic stopper sections 35 is in elastic contact with the outer surface of the wristwatch case 1.

As a result, when the exterior member 11 receives an external impact and the plurality of elastic stopper sections 35 of the cushioning member 10 are elastically deformed, the space S between the inner surface of the tip elastic projection 27 and the outer end surface of the operation head section 18 allows an escape of the impact associated with elastic deformation of the plurality of elastic stopper sections 35.

As a result, the external impact can be further mitigated, whereby the impact resistance can be further increased.

Third Embodiment

Figure 10:
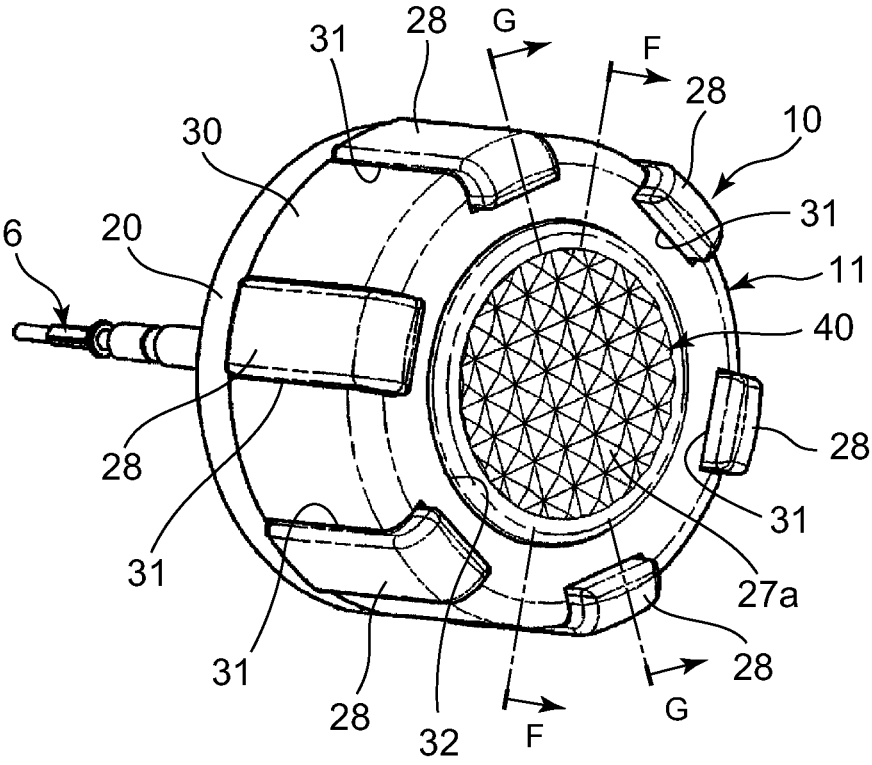
FIG. 10 is an enlarged perspective view of the main portion of a switch device according to a third embodiment in which the present invention has been applied to a switch device of a wristwatch.

Next, a third embodiment in which the present invention has been applied to a switch device of a wristwatch is described below with reference to FIG. 10 to FIG. 12.

In this case as well, components identical to those of the first embodiment depicted in FIG. 1 to FIG. 5B are provided with the same reference numerals for description.

Figure 11:
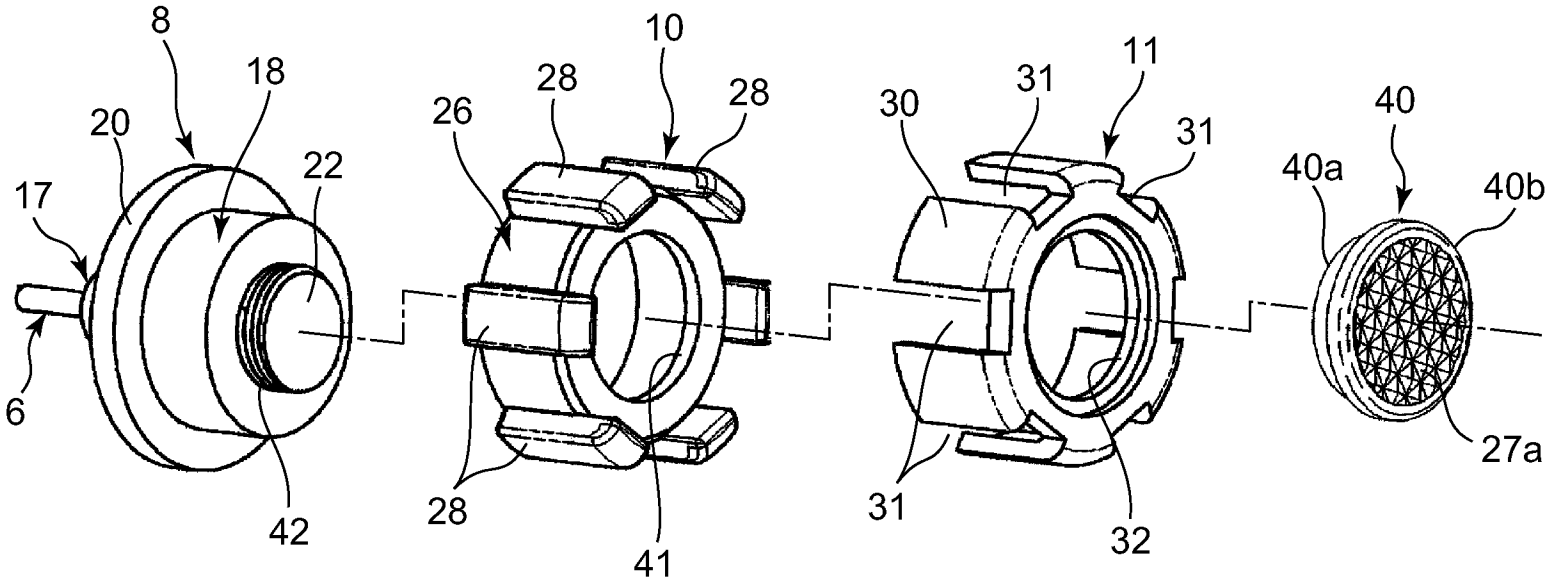
FIG. 11 is an enlarged sectional view of the main portion of the switch device depicted in FIG. 10.

As depicted in FIG. 11, the switch device 5 of the wristwatch is structured to include a mount piece 40 for mounting the cushioning member 10 and the exterior member 11 on the operation head section 18. Except for this point, the switch device 5 is substantially identical in structure to that of the first embodiment.

Figure 12A:
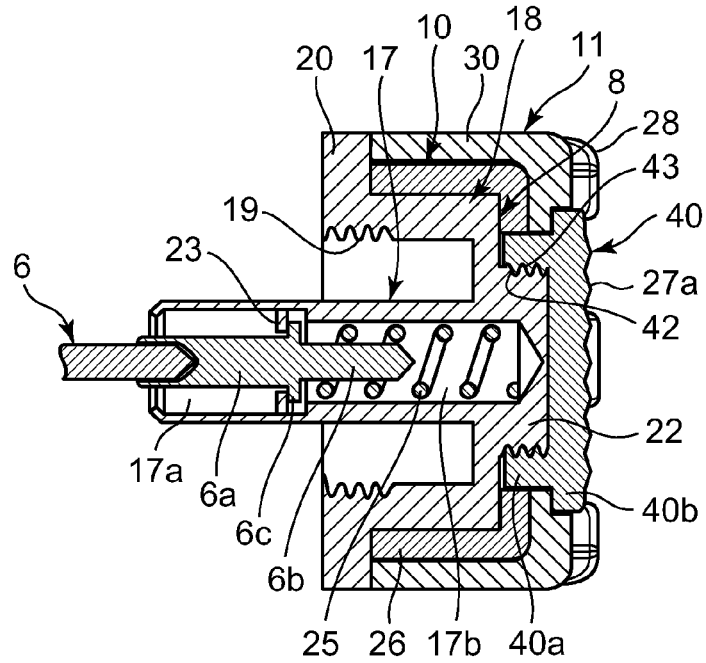
Figure 12B:
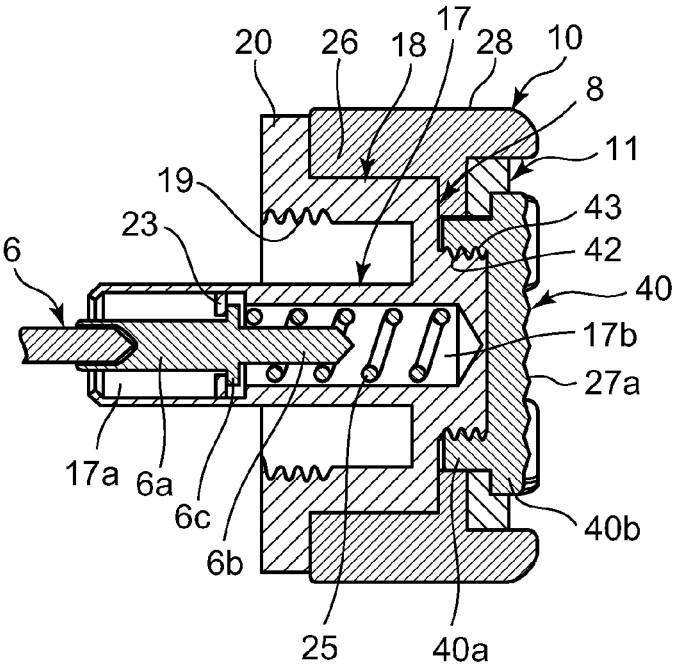
Figure 13:
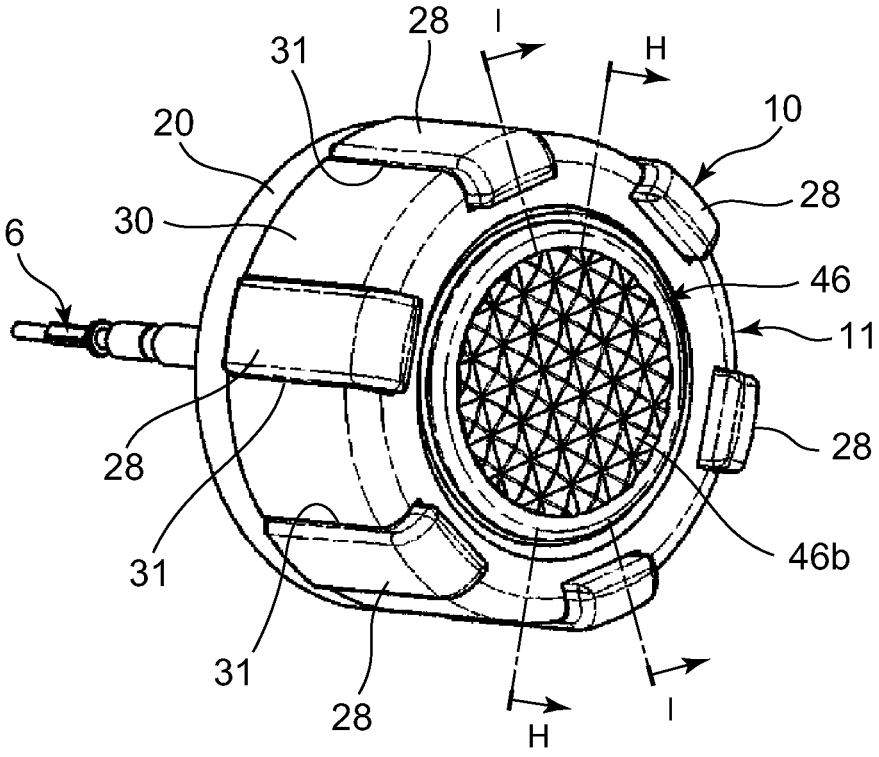
FIG. 13 is an enlarged sectional view of a switch device according to a fourth embodiment in which the present invention has been applied to a switch device of a wristwatch.

In this case, the cushioning body 26 of the cushioning member 10 has an outer end surface provided with an insertion hole 41, as depicted in FIG. 11 and FIG. 12.

The mount piece 40 is structured to be formed in a disk shape made of metal and be screwed into the projection 22 provided to the outer end surface of the operation head section 18.

That is, the mount piece 40 has a small circular section 40*a* that is inserted into the insertion hole 41 of the cushioning body 26 and the insertion hole 32 of the exterior member 11 and a large circular section 40*b* that abuts on the edge of the insertion hole 32 of the exterior member 11.

In this case, the small circular section 40*a* has a female screw section 43 provided therein which is screwed into a male screw section 42 provided to the projection 22 of the operation head section 18, as depicted in FIG. 11 and FIG. 12.

As with the first embodiment, the concavo-convex section 27*a* is provided to the outer end surface of the large circular section 40*b*.

As a result, the mount piece 40 is structured to attach the cushioning body 26 to the operation head section 18, attach the exterior member 11 to the cushioning body 26, and mount the cushioning body 26 and the exterior member 11 on the operation head section 18.

That is, the mount piece 40 is structured such that, in the state where the cushioning body 26 has been attached to the operation head section 18 and the exterior member 11 has been attached to the cushioning body 26, when the small circular section 40*a* of the mount piece 40 is inserted from the insertion hole 32 of the exterior member 11 into the insertion hole 41 of the cushioning body 26 and the female screw section 43 of the small circular section 40*a* is screwed into the male screw section 42 of the projection 22 of the operation head section 18, the outer perimeter of the large circular section 40*b* presses the edge of the insertion hole 32 of the exterior member 11, as depicted in FIG. 11 and FIG. 12.

With this switch device 5 of the wristwatch, operations and effects similar to those of the first embodiment can be achieved. In addition, the switch device 5 includes the insertion hole 41 formed on the outer end surface of the cushioning body 26 of the cushioning member 10 attached to the outer peripheral surface of the operation head section 18, and the mount piece 40 which presses the exterior member 11 onto the cushioning body 26 and fixes the exterior member 11 to the operation head section 18 by screwing the exterior member 11 into the outer end of the operation head section 18 via the insertion hole 32 formed on the outer end surface of the exterior member 11.

As a result, the exterior member 11 can be easily and reliably pressed onto the cushioning body 26 and be fixed to the operation head section 18.

That is, in the switch device 5, the mount piece 40 includes the small circular section 40*a* that has the female screw section 43 and the large circular section 40*b* that presses the edge of the insertion hole 32 of the exterior member 11. Therefore, in the state where the cushioning body 26 has been attached to the operation head section 18 and the exterior member 11 has been attached to the cushioning body 26, when the small circular section 40*a* of the mount piece 40 is inserted from the insertion hole 32 of the exterior member 11 into the insertion hole 41 of the cushioning body 26 and the female screw section 43 of the small circular section 40*a* is screwed into the male screw section 42 of the projection 22 of the operation head section 18, the outer perimeter of the large circular section 40*b* can press the edge of the insertion hole 32 of the exterior member 11.

As a result, attaching and dissembling operations can be easily performed.

Fourth Embodiment

Next, a fourth embodiment in which the present invention has been applied to a switch device of a wristwatch is described below with reference to FIG. 13 to FIG. 15B.

In this case as well, components identical to those of the first embodiment depicted in FIG. 1 to FIG. 5B are provided with the same reference numerals for description.

Figure 14:
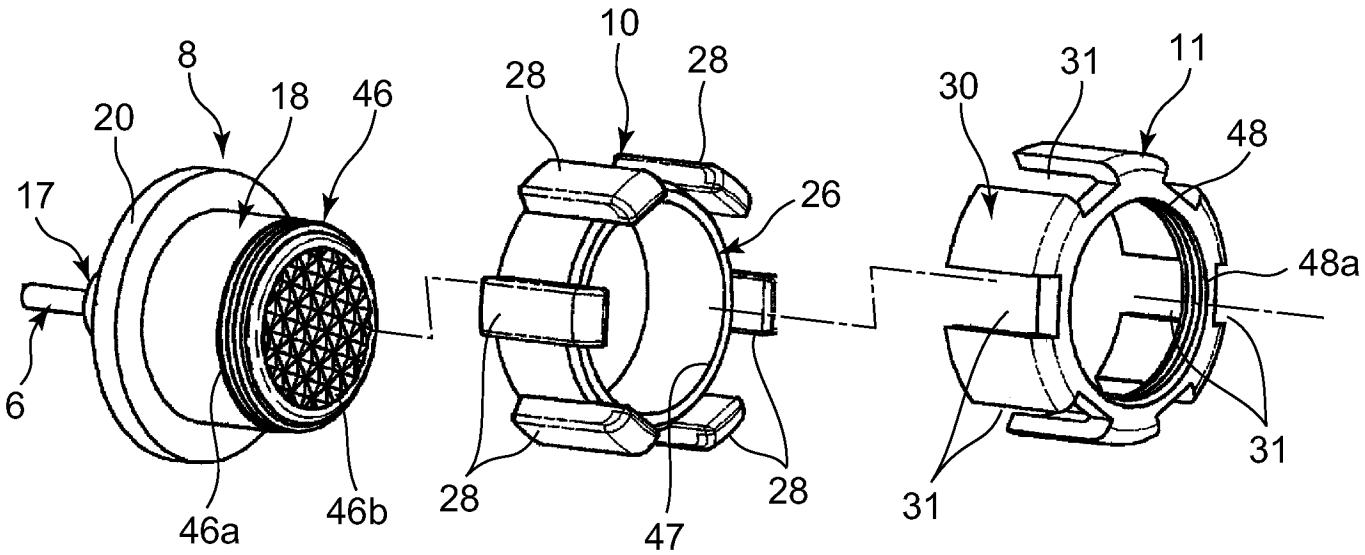
FIG. 14 is an enlarged exploded perspective view of the main portion of the switch device depicted in FIG. 13.

As depicted in FIG. 14, the switch device 5 of the wristwatch is structured to include a mount section 46 for mounting the exterior member 11 on the operation head section 18. Except for this point the switch device 5 is substantially identical in structure to that of the first embodiment.

Figure 15A:
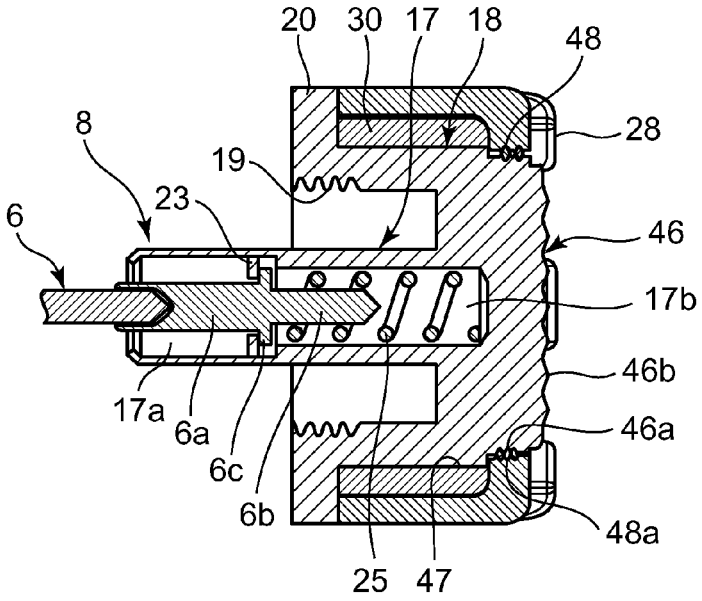
Figure 15B:
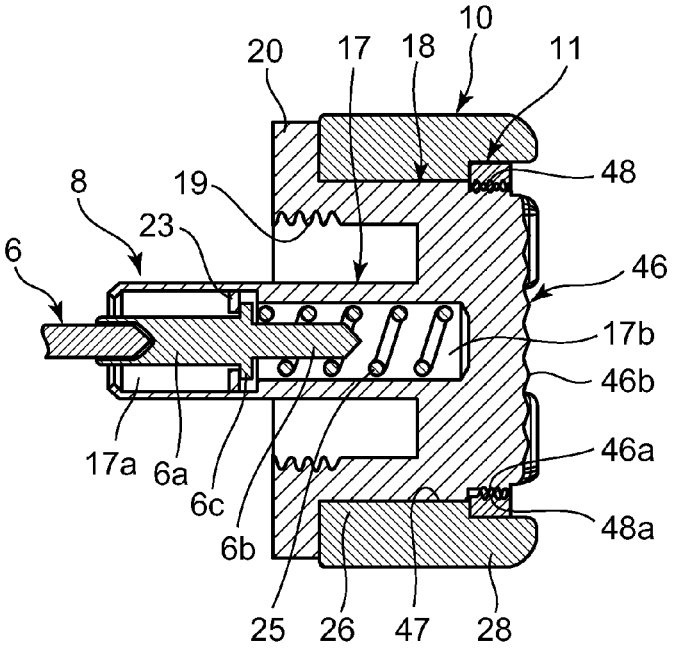

That is, the mount section 46 has a male screw section 46*a* formed on the outer peripheral surface of the operation head section 18 positioned on the outer end side (in FIG. 14, right end side) and an concavo-convex section 46*b* formed on the outer peripheral surface of the operation head section 18, as depicted in FIG. 14, FIG. 15A and FIG. 15B.

The cushioning body 26 of the cushioning member 10 is provided with an insertion hole 47 in which the mount section 46 of the operation head section 18 is inserted.

Also, the exterior member 11 has an outer end (in FIG. 14, right end) provided with an insertion hole 48 in which the mount section 46 of the operation head section 18 is inserted.

The insertion hole 48 has an inner peripheral surface provided with a female screw section 48*a* into which the male screw section 46*a* of the mount section 46 is screwed, as depicted in FIG. 14, FIG. 15A and FIG. 15B.

As a result, the mount section 46 of the operation head section 18 is structured such that, when the mount section 46 is inserted into the insertion hole 48 of the exterior member 11 through the insertion hole 47 of the cushioning member 10, the male screw section 46*a* of the mount section 46 is screwed into the female screw section 48*a* of the exterior member 11.

That is, as depicted in FIG. 14, FIG. 15A and FIG. 15B, the mount section 46 of the operation head section 18 is structured such that, when the cushioning body 26 is attached to the operation head section 18 to cause the male screw section 46*a* to be inserted into the insertion hole 47 of the cushioning body 26 so as to project, and the exterior member 11 is attached to the cushioning body 26, the male screw section 46*a* corresponds to the insertion hole 48 of the exterior member 11. In this state, when the exterior member 11 is rotated, the male screw section 46*a* is screwed into the female screw section 48*a* of the insertion hole 48 and whereby the exterior member 11 is attached to the operation head section 18 with the exterior member 11 pressing the cushioning body 26.

With this switch device 5 of the wristwatch as well, operations and effects similar to those of the first embodiment can be achieved. In addition, the operation head section 18 of the operation member 8 has the mount section 46 that is screwed into the exterior member 11 through the insertion hole 47 provided to the outer end surface of the cushioning member 10, whereby the number of components can be reduced more than the third embodiment.

Furthermore, the exterior member 11 can be pressed onto the cushioning member 10 and be fixed to the operation head section 18 more easily and reliably than the third embodiment.

That is, in the switch device 5, when the cushioning body 26 is attached to the operation head section 18 to cause the male screw section 46*a* of the mount section 46 to be inserted into the insertion hole 47 of the cushioning body 26 so as to project, and the exterior member 11 is attached to the cushioning body 26, the male screw section 46*a* of the mount section 46 corresponds to the insertion hole 48 of the exterior member 11. In this state, when the exterior member 11 is rotated, the male screw section 46*a* is screwed into the female screw section 48*a* of the insertion hole 48 and whereby the exterior member 11, can be attached to the operation head section 18 with the exterior member 11 pressing the cushioning body 26 by the mount section 46.

As a result, attaching and dissembling operations can be easily performed.

In the above-described first to fourth embodiments, the lock section 9 is structured by the male screw section 14 provided to the cylindrical member 7 and the female screw section 19 provided to the operation head section 18.

However, the present invention is not limited thereto. For example, as described in the related art documents, the lock section may be a simplified lock section including a ring member having a plurality of engaging projections attached to an operation head section and a plurality of engaging groove sections provided to the outer perimeter of a cylindrical member projecting outwardly from a wristwatch case to engageably lock the engaging projections of the ring member.

Also, in the above-described first to fourth embodiments, the present invention is applied to a wristwatch. However, the present invention is not necessarily applied to a wristwatch, and can be applied to various timepieces such as a travel watch, an alarm clock, a desk clock, and a wall clock.

While the present invention has been described with reference to the preferred embodiments, it is intended that the invention be not limited by any of the details of the description therein but includes all the embodiments which fall within the scope of the appended claims.

What is claimed is:

1. A device comprising:

a case having a through hole;

a cylindrical member provided in the through hole of the case;

an operation member having a shaft section inserted into the cylindrical member and an operation section provided at an outer end of the operation member;

a cushioning member attached to the operation section of the operation member to cover the operation section; and an exterior member fixed to the operation section to cover the cushioning member and from which a plurality of portions of the cushioning member project outwardly, wherein the exterior member has a plurality of slit grooves provided from an outer peripheral surface to an outer end surface along a circumferential direction at predetermined intervals, and wherein the plurality of portions of the cushioning member comprise a plurality of outer peripheral elastic projections which are respectively inserted into the plurality of slit grooves of the exterior member to project outwardly from the outer peripheral surface and from the outer end surface of the exterior member.

2. The device according to claim 1, wherein the exterior member has an insertion hole provided in the outer end surface thereof, and the cushioning member is provided with a tip elastic projection which projects outwardly from the insertion hole of the exterior member.

3. The device according to claim 1, further comprising:

a lock section which locks the operation member in a state of being pressed in toward the case, wherein the cushioning member is provided with an elastic stopper section which elastically comes in contact with an outer surface of the case in a state in which the operation member is locked by the lock section.

4. The device according to claim 3, wherein the cushioning member and the operation section have a space provided therebetween along an axial direction of the operation member.

5. The device according to claim 1, further comprising:

a mount piece which is screwed into an outer end of the operation section through an insertion hole formed in an outer end surface of the cushioning member and an insertion hole formed in outer end surface of the exterior member, presses the exterior member onto the cushioning member, and fixes the exterior member to the operation section.

6. The device according to claim 1, wherein the operation section of the operation member comprises a mount section which is screwed into the exterior member through an insertion hole provided in an outer end surface of the cushioning member.

* * * * *